US010640321B2

(12) United States Patent
Maddalon

(10) Patent No.: US 10,640,321 B2
(45) Date of Patent: May 5, 2020

(54) AUTOMATIC METHOD AND DEVICE FOR CUTTING SUBSTRATES HAVING PRINTED IMAGES

(71) Applicant: FOTOBA INTERNATIONAL S.R.L., Quaregna (BI) (IT)

(72) Inventor: Valter Maddalon, Pralungo (IT)

(73) Assignee: FOTOBA INTERNATIONAL S.R.L., Quaregna (BI) (IT)

( * ) Notice: Subject to any disclaimer, the term of this patent is extended or adjusted under 35 U.S.C. 154(b) by 0 days.

(21) Appl. No.: 16/097,639

(22) PCT Filed: May 11, 2017

(86) PCT No.: PCT/IB2017/052766
§ 371 (c)(1),
(2) Date: Oct. 30, 2018

(87) PCT Pub. No.: WO2017/203384
PCT Pub. Date: Nov. 30, 2017

(65) Prior Publication Data

US 2019/0152735 A1 May 23, 2019

(30) Foreign Application Priority Data

May 25, 2016 (IT) ..... 102016000053860

(51) Int. Cl.
*B26D 5/00* (2006.01)
*B65H 35/00* (2006.01)
(Continued)

(52) U.S. Cl.
CPC ..... *B65H 35/0086* (2013.01); *B41F 13/58* (2013.01); *B41F 13/60* (2013.01);
(Continued)

(58) Field of Classification Search
CPC ..... B26D 5/32; B26D 5/07; B41J 11/663
(Continued)

(56) References Cited

U.S. PATENT DOCUMENTS 3,811,768 A * 5/1974 Zahn ..... G03B 17/245 355/29
4,436,008 A * 3/1984 Strunc ..... B26D 5/32 83/210

(Continued)

FOREIGN PATENT DOCUMENTS

EP 1883510 A1 2/2008
JP 59026854 A * 2/1984 ..... B65H 43/08

OTHER PUBLICATIONS

International Search Report and Written Opinion for Corresponding International Application No. PCT/IB2017/052766 (12 Pages) (dated Sep. 15, 2017).

*Primary Examiner* — Kenneth E Peterson
(74) *Attorney, Agent, or Firm* — Lucas & Mercanti, LLP

(57) ABSTRACT

The invention relates to a method for cutting substrates with printed images in an automatic cutting device. The longitudinal cutting marks (LM) are provided with a discontinuity (N) arranged upstream of each transverse cutting mark (TM) with respect to a feeding direction (F) of a substrate (S) and spaced therefrom by a predefined known measure (d). The automatic cutting device has a first optical unit configured to detect the transverse cutting marks (TM) and a second optical unit configured to detect the discontinuities (N) in the longitudinal cutting mark (LM). Since the velocity of the substrate is known, the control system activates the first optical unit when the transverse cutting mark (TM) actually passed underneath it.

3 Claims, 2 Drawing Sheets

(51) Int. Cl.

| | |
|---|---|
| ***B41J 11/70*** | (2006.01) |
| ***B65H 35/02*** | (2006.01) |
| ***B41F 13/58*** | (2006.01) |
| ***B65H 35/04*** | (2006.01) |
| ***B41J 11/68*** | (2006.01) |
| ***B41F 13/60*** | (2006.01) |
| ***B41J 11/66*** | (2006.01) |
| ***B65H 16/00*** | (2006.01) |
| *B26D 1/10* | (2006.01) |
| *B26D 11/00* | (2006.01) |

(52) U.S. Cl.
CPC ..... *B41J 11/663* (2013.01); *B41J 11/68* (2013.01); *B41J 11/706* (2013.01); *B65H 16/005* (2013.01); *B65H 35/02* (2013.01); *B65H 35/04* (2013.01); *B26D 1/105* (2013.01); *B26D 5/007* (2013.01); *B26D 2011/005* (2013.01); *B65H 2301/5151* (2013.01); *B65H 2301/5155* (2013.01)

(58) Field of Classification Search
USPC ..... 83/371
See application file for complete search history.

(56) References Cited

U.S. PATENT DOCUMENTS

| | | | | | |
|---|---|---|---|---|---|
| 4,781,090 | A * | 11/1988 | Feldkamper | B26D 5/32 | 83/312 |
| 5,239,902 | A * | 8/1993 | Kaule | B26D 5/32 | 83/13 |
| 6,427,306 | B2 * | 8/2002 | Karaki | G03B 17/26 | 242/534 |
| 6,536,892 | B1 * | 3/2003 | Chang | B41J 11/008 | 347/101 |
| 2009/0028417 | A1 | 1/2009 | Floeder | | |
| 2010/0162865 | A1 * | 7/2010 | Innocenzo | B26D 5/32 | 83/73 |

* cited by examiner

AUTOMATIC METHOD AND DEVICE FOR CUTTING SUBSTRATES HAVING PRINTED IMAGES

CROSS-REFERENCE TO RELATED APPLICATIONS

This application is a 371 of PCT/IB2017/052766, filed May 11, 2017, which claims the benefit of Italian Patent Application No. 102016000053860, filed May 25, 2016.

FIELD OF THE INVENTION

The present invention generally relates to the field of automatic devices for cutting substrates on which a plurality of images are printed. Substrates of this type are in particular strips of paper, cloth, PVC and the like, that are provided in the form of sheets or wound in rolls. More particularly, the invention relates to a cutting method and a device providing for the correction of alignment errors of a substrate, wherein correction is based on the detection of longitudinal and transverse cutting marks printed along the edges of the images.

BACKGROUND OF THE INVENTION

It is known that graphic and photographic techniques, including digital rendering, are undergoing deep changes and are being developed by abandoning prints made by way of traditional optical systems and increasingly focusing on inkjet printing technology from digital files on sheets or rolls providing substrates having the most varied features and dimensions.

The individual images are obtained by cutting processes whereby the substrates are introduced into automatic cutting devices having cutting units configured to make cuts in a longitudinal direction, parallel to a feeding direction, as well as in a transverse direction perpendicular to the feeding direction.

The longitudinal cutting units of these automatic cutting devices are typically restrained to a transverse bar along which they are locked at predetermined positions corresponding to the longitudinal edges of the images printed on the substrate. At least one transverse cutting unit is instead movable along a cross bar, for example by way of an electric motor and a toothed transmission belt.

These cutting devices may advantageously be provided with means for correcting alignment errors of the substrate with respect to the feeding direction and to the transverse direction along which the longitudinal and transverse cutting units operate.

To this aim, suitable cutting marks that stretch out in the longitudinal, or feeding, direction and in the transverse direction are printed on the substrate close to the images and parallel to their edges. The cutting marks consist of one or more parallel black bands that indicate the position and orientation of the images printed on the substrate and therefore serve as a reference for the cutting operations.

An example of such a substrate is described by U.S. Pat. No. 6,536,892 B1, according to which the images and the transverse and longitudinal cutting marks are printed together with a same printing head.

The correcting means of the cutting devices typically include optical units, such as e.g. reflective optical cells, that are operably connected to a control system in turn comprising a microprocessor provided with a suitable control program.

When a printed substrate is made to advance in the longitudinal or feeding direction, the optical units focus the cutting marks, check their position, and whenever misalignments of the images printed on the substrate are detected in the feeding direction and/or in the transverse direction, the control system operates suitable actuators and/or motorized rollers that correct the position of the bars or guides on which the cutting units are mounted.

Patent EP 1883510 B1 in the Applicant's name describes an automatic cutting method and an automatic cutting device according to the preamble of the independent claim 1 and the independent claim 4, respectively.

The aforementioned automatic cutting devices with the related correcting means have been developed for the so-called "large format" printers, meaning that they can print images on substrates having a width of 1600 mm or larger. However, applications for smaller format printers are more and more required.

In the case of images printed on large format substrates, the cutting marks may generally be clearly distinguished from the printed images, so that the optical units of the automatic correcting means operate substantially free from alignment and/or cutting errors.

On the contrary, in the case of lower-size substrates, the cutting marks may be confused with portions and/or details of the printed images, as well as with text elements, due to their lower scale. Hence, there is a possibility that the optical units of the correcting means make reading errors and, consequently, it is likely that the correcting means intervene only partially or not at all.

This problem essentially concerns the transverse cutting marks, which are printed between consecutive images in the longitudinal or feeding direction, whereas no problem substantially exists as far as the longitudinal cutting marks are concerned, because these are continuous lines extending over the whole length of a substrate in the feeding direction.

SUMMARY OF THE INVENTION

There is therefore a need to improve the automatic cutting methods and devices providing for correction of alignment errors, which is an object of the present invention.

Said object is achieved by a method and an automatic device, whose main features are specified in claims 1 and 4, respectively, while other features are specified in the remaining claims.

An idea of solution underlying the invention is to modify the longitudinal cutting marks by providing them with a discontinuity arranged upstream of each transverse cutting mark with respect to the feeding direction and spaced from each transverse cutting mark by a predefined known measure. Correspondingly, an automatic cutting device having means for correcting alignment errors is provided with an optical unit operatively connected to a control system thereof and configured to detect the discontinuities such that, the substrate feeding velocity being known, the optical units intended to detect the transverse cutting marks are selectively activated when the latter actually pass under them.

It is thus possible to reliably solve the technical problem of detecting the transverse cutting marks, which affects the automatic cutting devices providing for errors correction, more particularly the devices configured to cut substrates having a width smaller than 1600 mm.

The main advantage offered by the invention is that the cutting method may be implemented in an extremely cost effective way. On the one hand in fact it is sufficient to print longitudinal cutting marks having periodic discontinuities at known positions. On the other hand it is sufficient to provide an automatic cutting device with an optical unit configured to detect such discontinuities and to set up a microprocessor of the control system so that the optical units intended to detect the transverse cutting marks are activated upon detection of the discontinuities formed in the longitudinal cutting marks.

Another advantage offered by the invention is that the optical units used to detect discontinuities may also be used to monitor the longitudinal cutting marks when a substrate proceeds in the feeding direction and to correct possible alignment errors with reference to these cutting marks.

BRIEF DESCRIPTION OF THE DRAWINGS

Further advantages and features of the present invention will become clear to those skilled in the art from the following detailed and non-limiting description of embodiments thereof with reference to the accompanying drawings wherein.

DETAILED DESCRIPTION OF THE INVENTION

Figure 1:
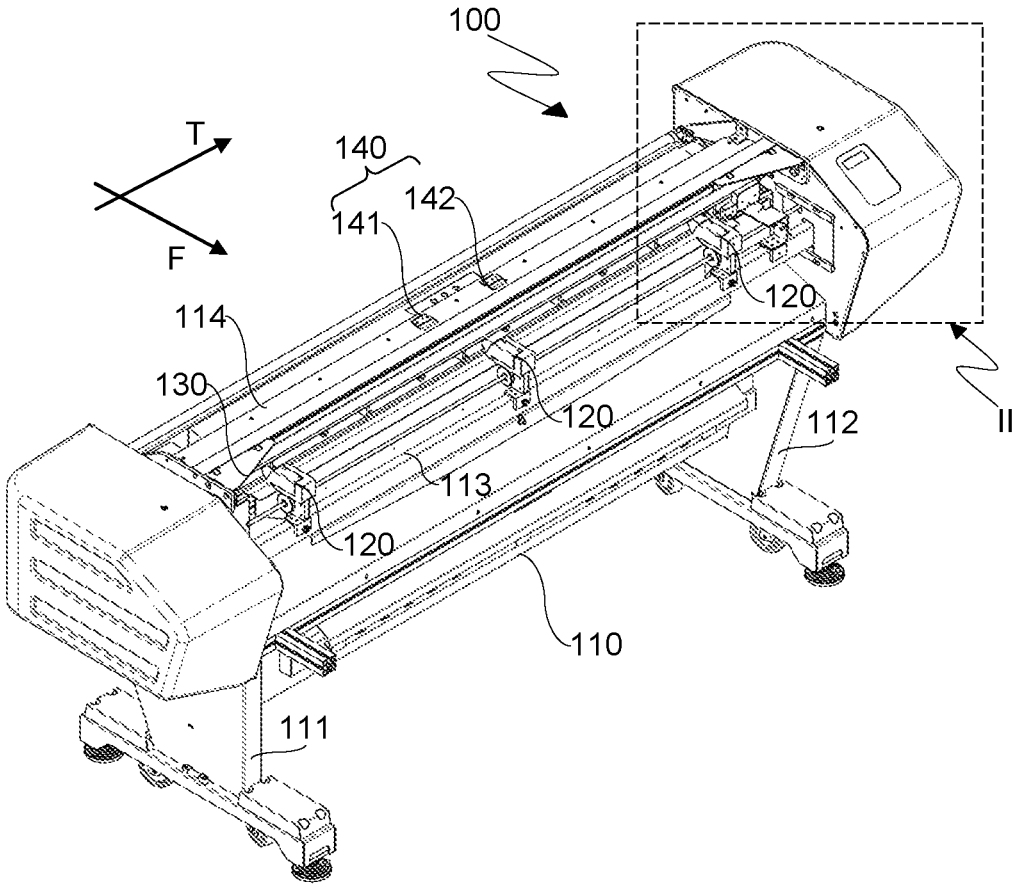
FIG. 1 is a perspective view showing an automatic cutting device according to the invention.
Figure 2:
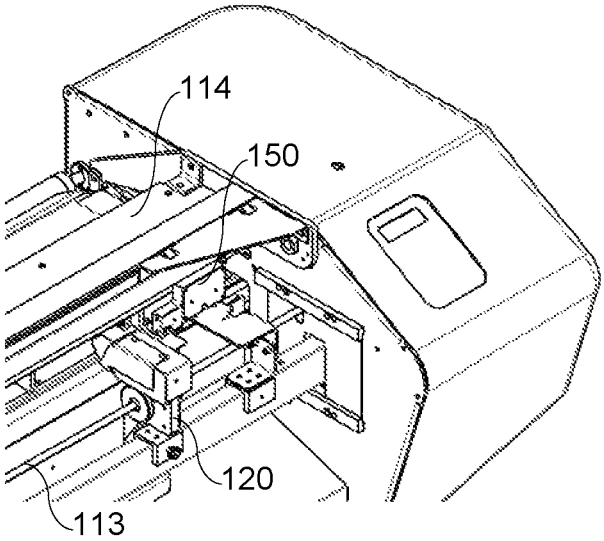
FIG. 2 shows a detail II of FIG. 1.

Referring to FIGS. 1 and 2, an automatic cutting device according to the invention for the cutting of substrates having printed images is generally indicated by reference numeral 100.

The device 100 includes a frame 110, for example a frame movable on wheels, comprising in a known manner a pair of uprights 111, 112 supporting a plane (not shown) intended to receive a substrate S having a plurality of printed images with the related cutting marks. A plurality of drag rollers (not shown) are also mounted on the frame 110 so as to allow to move the substrate S in a longitudinal or feeding direction between an inlet and outlet of the cutting device 100. The longitudinal or feeding direction is schematically indicated by an arrow F.

The cutting device 100 further comprises one or more longitudinal cutting units 120 configured to cut the substrate S in the feeding direction F and at least one transverse cutting unit 130 configured to cut the substrate S in a transverse direction T perpendicular to the feeding direction F.

The longitudinal cutting units 120 are restrained to a bar 113 of the frame 110 extending between the uprights 111, 112 in the transverse direction T. The position of the longitudinal cutting units 120 along the bar 113 in the transverse direction T can be modified manually or automatically, depending on the number of images printed on substrate S and on their layout. The transverse cutting unit 130 is movable along a guide 114 of the frame 110 extending between the uprights 111, 112 in the transverse direction T parallel to the bar 113. The transverse cutting unit 130 may e.g. be driven by a motor through a transmission belt.

The cutting device 100 further comprises means for correcting alignment errors of the substrate S relative to the feeding direction F and the transverse direction T along which the longitudinal cutting units 120 and the transverse cutting unit 130 operate. The correcting means include optical units, such as reflective optical cells, that are operably connected to a control system (not shown) of the device 100 comprising a microprocessor provided with a suitable control program. It is known that the correction of errors is based on the detection of longitudinal and transverse cutting marks printed on the substrate along the edges of the images.

In the embodiment shown in the drawings, the device 100 comprises a first optical unit 140, for example consisting of two reflective optical cells 141, 142 which may be associated with the guide 114 along which the transverse cutting unit 130 is moved. The first optical unit 140 is e.g. arranged in the middle of the guide 114 and the two reflective optical cells 141, 142 are spaced apart in transverse direction T so as to allow to detect alignment errors of the substrate relative to the transverse cutting marks printed thereon.

According to the invention, the cutting device 100 further comprises a second optical unit 150 operably connected to the control system and cooperating with the first optical unit 140 so as to send a confirmation of the actual passage of a transverse cutting mark to the control system.

The second optical unit 150, e.g. in the form of a linear CCD sensor or an equivalent sensor, comprises two reading points 151, 152 that are mutually spaced apart in the transverse direction T, and is arranged close to one of uprights of the frame, e.g. the upright 112, so that the two reading points 151, 152 are positioned opposite to each other with respect to a longitudinal cutting mark printed on the substrate S that proceeds in the feeding direction F.

Figure 3:
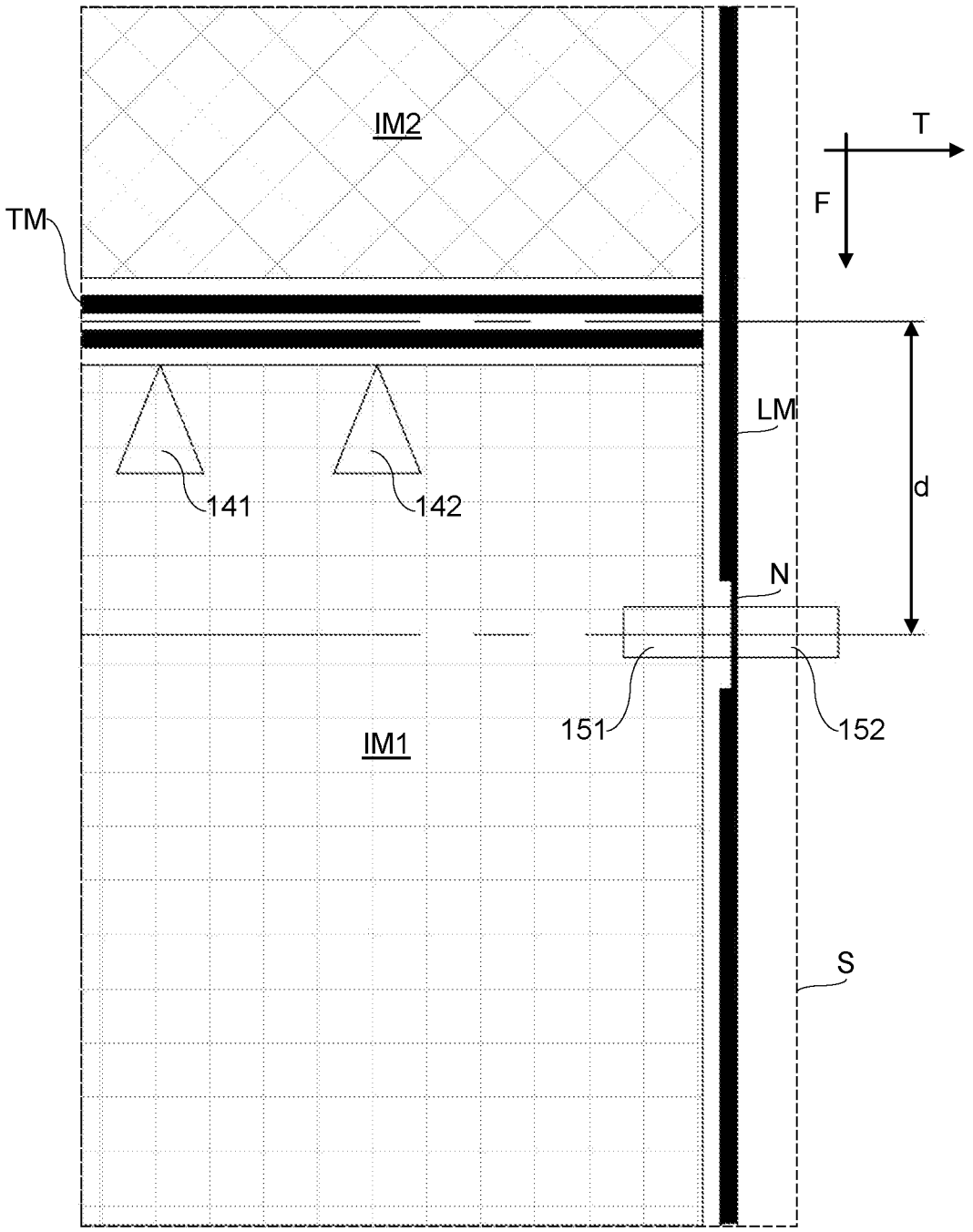
FIG. 3 is a top plan view schematically showing a portion of a substrate having two printed images and related cutting marks when the substrate passes through the automatic cutting device.

FIG. 3 schematically shows a substrate S passing through the automatic cutting device 100 in the feeding direction F. A plurality of images IM1, IM2, etc. are printed on the substrate S consecutively in the feeding direction F. Transverse cutting marks TM, e.g. consisting of a pair of parallel black bands, are printed between consecutive images. A longitudinal cutting mark LM is printed close to an edge of the substrate S and extends parallel to the images IM1, IM2 in the feeding direction F.

According to the invention, the longitudinal cutting mark LM comprises a discontinuity, for example in the form of an indentation N, an interruption or the like, located upstream of each transverse cutting mark TM with respect to the feeding direction F and spaced therefrom by a predefined known measure "d", for example comprised between 150 mm and 200 mm. This measure is an input given to the control system of the automatic cutting device 100.

Since the velocity of the substrate S in the feeding direction F is known, detection of the discontinuity N in the longitudinal cutting mark LM by the second optical unit 150 allows the control system to know precisely when the transverse cutting marks TM following the discontinuity will pass under the first optical unit 140 configured to detect them. This allows to avoid detection errors and therefore errors when correcting the position of the substrate S. The activation of the first optical unit 140 by the control system is selectively performed upon detection of the discontinuity in the longitudinal cutting mark LM. In other words, detection of the discontinuity in the longitudinal cutting mark LM predicts arrival of the transverse cutting marks TM.

According to an embodiment of the invention, the device 100 may comprise a third optical unit (not shown) restrained to the frame 110 close to one of the uprights, e.g. the upright 112, and configured to detect alignment errors of the substrate S with reference to the longitudinal cutting mark LM printed thereon. The third optical unit may advantageously be arranged close to the second optical unit 150, thus forming a single reading block for the longitudinal cutting mark LM.

According to an alternative embodiment of the invention, the second optical unit 150 may be configured for detecting the discontinuity N in the longitudinal cutting mark LM preceding the transverse cutting TM, as well as for monitoring the longitudinal cutting mark LM, i.e. to control alignment of the substrate S.

The invention has herein been disclosed with reference to preferred embodiments thereof. It will be appreciated that there may be further embodiments relating to the same inventive idea, as defined by the scope of protection of the claims set forth below.

The invention claimed is:

1. A method for cutting substrates comprising printed images by way of an automatic cutting device, wherein said substrate comprises a longitudinal cutting mark close to an edge of said substrate and parallel to edges of said images in a longitudinal or feeding direction and a plurality of transverse cutting marks perpendicular to said longitudinal cutting mark, said transverse cutting marks being arranged between consecutive images printed on said substrate, said longitudinal cutting mark being printed such that it has a discontinuity arranged upstream of each transverse cutting mark with respect to said feeding direction, and said discontinuity being spaced from the respective transverse cutting mark by a predefined known measure, wherein said automatic cutting device comprises a first optical unit configured for the detection of said transverse cutting marks, a second optical unit configured for the detection of said discontinuities in the longitudinal cutting mark, a transverse cutting unit, and a control system for selectively activating said first optical unit, said method comprising the steps of:

feeding the substrate into said automatic cutting device;

detecting said discontinuities in the longitudinal cutting mark with said second optical unit;

the discontinuities of the longitudinal cutting mark are detected, selectively activating, with said control system, the first optical unit for the detection of transverse cut marks printed on the substrate;

detecting said transverse cutting mark with said first optical unit;

cutting said substrate with said transverse cutting unit in correspondence of said transverse cutting mark.

2. The cutting method according to claim 1, wherein the discontinuities of the longitudinal cutting mark are indentations.

3. The cutting method according to claim 1, wherein the second optical unit is configured to detect the discontinuities of the longitudinal cutting mark as well as to monitor the longitudinal cutting mark along the feeding direction and.

* * * * *